US008127511B2

(12) United States Patent
White

(10) Patent No.: US 8,127,511 B2
(45) **Date of Patent: *Mar. 6, 2012**

(54) MOLDED FIBERGLASS SIDELITE ASSEMBLY

(75) Inventor: Matthew White, Charlotte, NC (US)

(73) Assignee: Masonite Corporation, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/032,128

(22) Filed: Feb. 22, 2011

(65) Prior Publication Data

US 2011/0138715 A1 Jun. 16, 2011

Related U.S. Application Data

(63) Continuation of application No. 11/882,611, filed on Aug. 2, 2007, now Pat. No. 7,895,801.

(60) Provisional application No. 60/835,868, filed on Aug. 7, 2006.

(51) Int. Cl.
*E06B 3/70* (2006.01)
*E04C 2/34* (2006.01)

(52) U.S. Cl. ..... 52/455; 52/784.13

(58) Field of Classification Search ..... 52/204.54, 52/309.9, 455, 457, 458, 784.1, 784.12, 784.13, 52/784.15, 784.16, 792.1, 792.11, 795.1, 52/656.4, 212, 206

See application file for complete search history.

(56) References Cited

U.S. PATENT DOCUMENTS

| | | | | | |
|---|---|---|---|---|---|
| 956,556 | A * | 5/1910 | Wege | 52/800.17 |
| 3,070,197 | A * | 12/1962 | Musselman | 52/656.4 |
| 4,152,876 | A * | 5/1979 | Seely | 52/455 |
| 4,311,183 | A * | 1/1982 | Herbst et al. | 160/37 |
| 4,327,535 | A * | 5/1982 | Governale | 52/309.11 |
| 4,850,168 | A * | 7/1989 | Thorn | 52/207 |
| 4,860,512 | A * | 8/1989 | Thorn | 52/309.11 |
| 4,922,674 | A * | 5/1990 | Thorn | 52/309.15 |
| 4,965,030 | A * | 10/1990 | Thorn | 264/46.5 |
| 5,074,087 | A * | 12/1991 | Green | 52/309.9 |
| 5,369,869 | A * | 12/1994 | Bies et al. | 29/460 |
| 5,634,508 | A * | 6/1997 | Herbst | 160/371 |
| 5,644,870 | A * | 7/1997 | Chen | 49/501 |
| 5,836,120 | A * | 11/1998 | DeBower | 52/209 |
| 5,894,706 | A * | 4/1999 | Herbst | 52/782.1 |
| 6,148,582 | A * | 11/2000 | Ellingson | 52/656.4 |
| 6,161,363 | A * | 12/2000 | Herbst | 52/784.15 |
| 6,192,631 | B1 * | 2/2001 | Kenkel et al. | 49/501 |
| 6,272,801 | B1 * | 8/2001 | Suh | 52/211 |
| 6,430,889 | B1 * | 8/2002 | Nixon, Sr. | 52/656.4 |
| 6,681,541 | B2 * | 1/2004 | Wang Chen | 52/455 |
| 6,922,946 | B2 * | 8/2005 | Gerard | 49/505 |
| 2004/0006922 | A1 * | 1/2004 | Sibbett | 49/501 |
| 2006/0080924 | A1 * | 4/2006 | Sibbett | 52/455 |

* cited by examiner

*Primary Examiner* — Robert Canfield
*Assistant Examiner* — Christine T Cajilig
(74) *Attorney, Agent, or Firm* — Berenato & White, LLC

(57) ABSTRACT

A sidelite assembly including first and second panels with an opening for receiving a window or glazing is provided. The first and second panels include inner and out edge portions with ridges and/or channels that allow for the alignment and attachment of the first and second panels to one another.

20 Claims, 13 Drawing Sheets

MOLDED FIBERGLASS SIDELITE ASSEMBLY

CROSS REFERENCE TO RELATED APPLICATION AND CLAIM TO PRIORITY

This application is a continuation of application Ser. No. 11/882,611 filed on Aug. 2, 2007, now U.S. Pat. No. 7,895,801, the complete disclosure of which is incorporated herein by reference. This application is based on provisional application Ser. No. 60/835,868, filed Aug. 7, 2006, for Matthew White, the disclosure of which is incorporated herein by reference and to which priority is claimed under 35 U.S.C. §119(e).

FIELD OF THE INVENTION

The present invention relates to a sidelite assembly having first and second panels and a window. Each of the panels has an inner edge extending outwardly from a major planar portion and surrounding an opening. The inner edge includes a first portion having a ridge extending outwardly from a distal end thereof and a second portion having a channel extending inwardly from the distal end. An outer edge extends outwardly from the major planar portion and adjacent a periphery thereof, and includes a first portion having a ridge extending outwardly from a distal end thereof and a second portion having a channel extending inwardly from the distal end. The ridges of the first panel are aligned with and received in the channels of the second panel. The window is disposed within the opening.

BACKGROUND OF THE INVENTION

Sidelites and transom lites typically include a window unit having a glass or plastic window retained within a window frame. A solid or hollow core panel having first and second facings and a perimeter frame is provided which is sized to fit an opening adjacent the door. Many conventional designs for sidelight assemblies are thus similar to a design for a narrow door, including similar components to a door only sized to create a relatively narrow panel.

Various designs for compression molded door assemblies are known in the art. Some designs include a pair of compression molded door panels which include edges which align with and abut one another to form a hollow cavity for receiving a door core. However, such joints between the two panels tend to pull apart when the cavity of the door is foamed due to the pressure exerted by the foam. Butt joints are also not as durable if exposed to thermal fluctuations.

Other door assembly designs provide for a pair of compression molded door panels including edges which align and foil a lap joint. The first and second panels have different but complementary edges. As such, a separate mold is required for each panel, thereby increasing manufacturing costs.

Some door assembly designs include a window unit disposed within a cutout formed in first and second aligned molded panels. The panels are secured to a perimeter frame, forming a cavity between the two panels. Foam or other core material may be provided within the core. The cutout is formed in the panels by removing a central portion of both panels as well as the foam or core material therebetween. The window unit is then secured within the cutout. Such designs result in a considerable amount of waste given the cutout may represent 40% or more of the entire panel. Such designs may also be relatively expensive and complex to manufacture.

Other designs provide for specially formed first and second door panels which include molded inner edges for retaining a window unit. Such designs include a first panel having a configuration different from but complementary to a second panel. As such, manufacturing costs for such designs are relatively high given a dedicated die mold is required for each panel. In addition, many such designs fail to provide interlocking joints which maintain their integrity during foaming. As a result, foam tends to leak out between the two panels, rendering the door commercially unacceptable.

Conventional door assembly designs have not proven adequate as a sidelite design. Therefore, there is a need for a sidelite assembly that overcomes some or all of the above-noted problems, is relatively inexpensive to manufacture, and is relatively simply to assemble.

SUMMARY OF THE INVENTION

In accordance with a first aspect of the invention, a sidelite assembly is provided. The assembly features first and second panels having first and second major planar portions, respectively, that collectively define an opening for receiving a glazing panel. The first panel features a first inner edge portion and a first outer edge portion extending from the first major planar portion. The first inner edge portion surrounds the opening and includes an inner edge ridge extending from a distal end of the first inner edge portion. The first outer edge portion is positioned adjacent to a periphery of the first major planar portion and includes an outer edge ridge extending from a distal end of the first outer edge portion. The first panel further features a first extension edge portion including a first parallel leg extending parallel to the first major planar portion and a first perpendicular leg extending perpendicular to the first parallel leg, the first extension edge portion including an extension ridge extending from a distal end of the first extension edge portion. The second panel features a second inner edge portion and a second outer edge portion extending from the second major planar portion. The second inner edge portion surrounds the opening and has an inner edge channel extending into a distal end of the second inner edge portion. The second outer edge portion is positioned adjacent to the periphery of the second major planar portion and has an outer edge channel extending into a distal end of the second outer edge portion. The second panel further features a second extension edge portion including a second parallel leg extending parallel to the second major planar portion and a second perpendicular leg extending perpendicular to the second parallel leg, the second extension edge portion including an extension channel extending into a distal end of the second extension edge portion. The inner edge ridge and the outer edge ridge are received in the inner edge channel and the outer edge channel, respectively, to align the first and second panels with one another and form a cavity between the first and second major planar portions. The extension ridge is received in the extension channel, and the first and second extension edge portions are removable from the panels without disturbing the cavity.

A second aspect of the invention provides a sidelite assembly including first and second panels having first and second major planar portions, respectively, that collectively define an opening for receiving a glazing panel. The first panel features a first inner edge portion and a first outer edge portion extending from the first major planar portion, the first inner edge portion surrounding the opening, the first outer edge portion positioned adjacent to a periphery of the first major planar portion. The first inner edge portion includes a first inner edge ridge on a first half of the first panel relative to an imaginary longitudinal centerline and has a first inner edge channel on a second half of the first panel relative to the imaginary longitudinal centerline. The first outer edge portion includes a first outer edge ridge on the first half of the first panel relative to the imaginary longitudinal centerline and has a first outer edge channel on the second half of the first panel relative to the imaginary longitudinal centerline. The second panel features a second inner edge portion and a second outer edge portion extending from the second major planar portion, the second inner edge portion surrounding the opening, the second outer edge portion positioned adjacent to a periphery of the second major planar portion. The second inner edge portion includes a second inner edge ridge on a first half of the second panel relative to the imaginary longitudinal centerline and has a second inner edge channel on a second half of the second panel relative to the imaginary longitudinal centerline. The second outer edge portion includes a second outer edge ridge on the first half of the second panel relative to the imaginary longitudinal centerline and has a second outer edge channel on the second half of the second panel relative to the imaginary longitudinal centerline. The first and second panels further collectively form a removable extension edge. The first inner edge ridge and the first outer edge ridge are received in the second inner edge channel and the second outer edge channel, respectively, and the second inner edge ridge and the second outer edge ridge are received in the first inner edge channel and the first outer edge channel, respectively.

According to additional aspects of the invention, door and sidelite assemblies are provided.

DETAILED DESCRIPTION OF THE INVENTION

Figure 1:
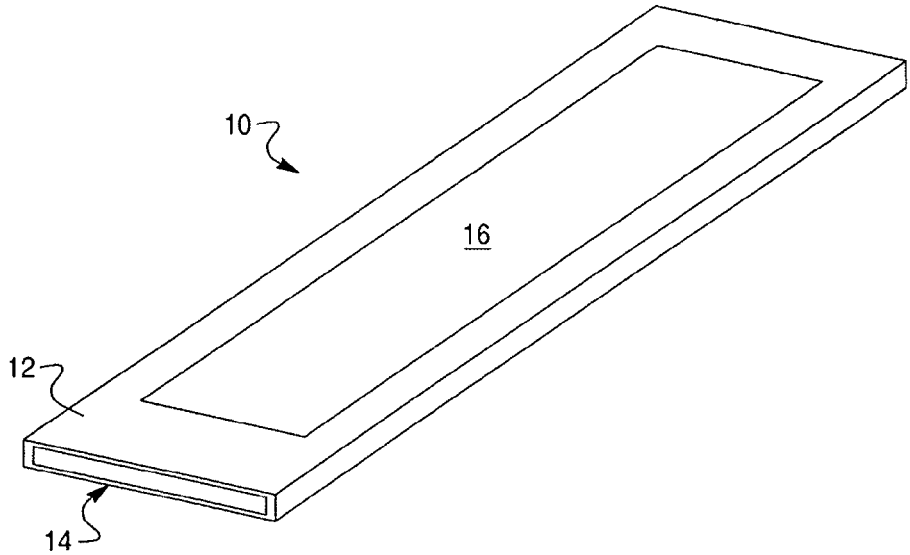
FIG. 1 is a perspective view of a sidelite assembly according to the present invention.
Figure 2:
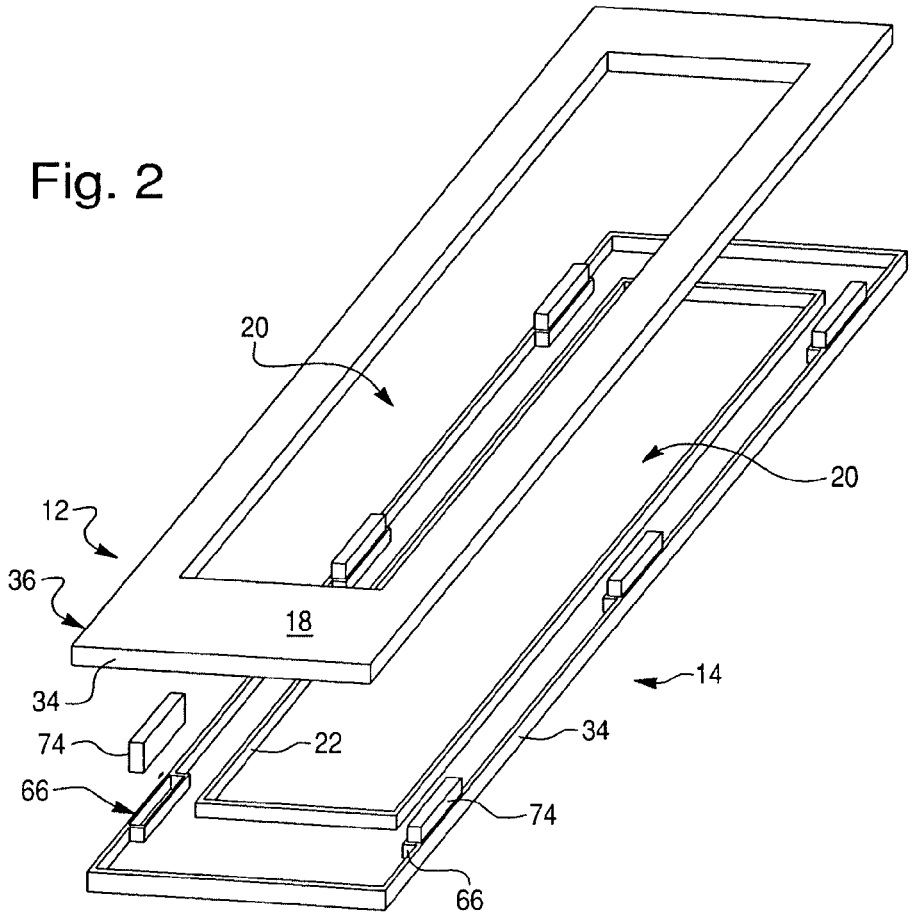
FIG. 2 is an assembly view of first and second panels for a sidelite assembly of the present invention.

As best shown in FIG. 1, a sidelite assembly 10 according to the present invention includes first and second molded panels 12, 14 and a glazing panel 16. Preferably, panels 12, 14 are formed from a fiberglass reinforced composite material, such as sheet molding compound. As best shown in FIG. 2, each of panels 12, 14 has a major planar surface 18 defining an opening 20.

As best shown in FIGS. 2, 3, 4 and 5, an inner edge 22 extends outwardly from major planar surface 18 and surrounds opening 20. As best shown in FIGS. 6, 7, 8 and 9, inner edge 22 includes a first portion 24 having a ridge 26 extending outwardly from a distal end 28 of inner edge 22, and a second portion 30 having a channel 32 extending inwardly from distal end 28. Referring again to FIGS. 2-5, an outer edge 34 extends outwardly from major planar surface 18 adjacent a periphery 36 thereof. As shown in FIGS. 6-9, outer edge 34 includes a first portion 38 having ridge 40 extending outwardly from a distal end 42 of outer edge 34, and a second portion 44 having a channel 46 extending inwardly from distal end 42. Channels 32 and 46 preferably have identical configurations. Likewise, ridges 26, 40 preferably have identical configurations.

Figure 10:
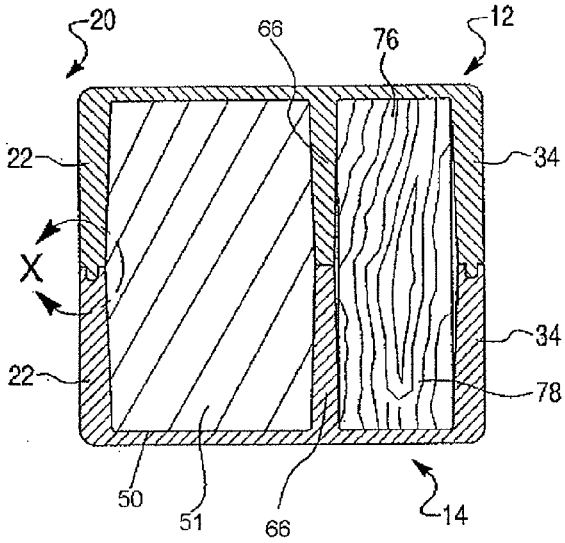
FIG. 10 is a fragmentary sectional view of a sidelite assembly of the present invention.
Figure 11:
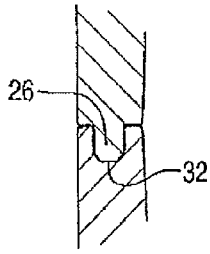
FIG. 11 is an exploded view of circled portion X shown in FIG. 10.

As best shown in FIGS. 10 and 11, ridge 26 of first panel 12 is received in channel 32 of second panel 14 and ridge 40 of first panel 12 is received in channel 46 of second panel. Panels 12, 14 are configured such that inner and outer edges 22, 34 and openings 20 of each panel 12, 14 are aligned when ridges 26, 40 are disposed within channels 32, 46. When panels 12, 14 are secured together, glazing panel 16 may be secured within openings 20.

A cavity 50 is formed between connected panels 12, 14, which may be filled with a foam core material such as polyurethane foam or expanded polystyrene. Alternatively, a solid core formed from a composite wood material, cardboard, or the like may be provided.

Figure 3:
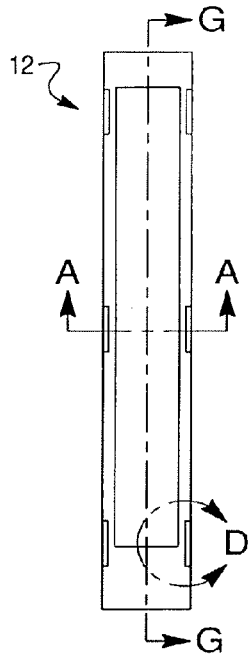
FIG. 3 is a plan view of a panel for a sidelite assembly of the present invention.

As shown in FIGS. 1-3, first and second panels 12, 14 have a rectangular configuration in plan view. Opening 20 also has a rectangular configuration in plan view. Preferably, the configuration of panel 12 is identical to that of panel 14. Thus, two panels 12 or 14 may be used to form sidelite assembly 10. In this way, only one die mold is required for both 'halves' of sidelite assembly 10, thereby reducing manufacturing costs. Ridges 26, 40 of panel 12 are disposed on panel 12 (or 14) such that they will align with channels 32, 46 when inner and outer edges of two panels 12 (or 14) are abutting and aligned.

Figure 12:
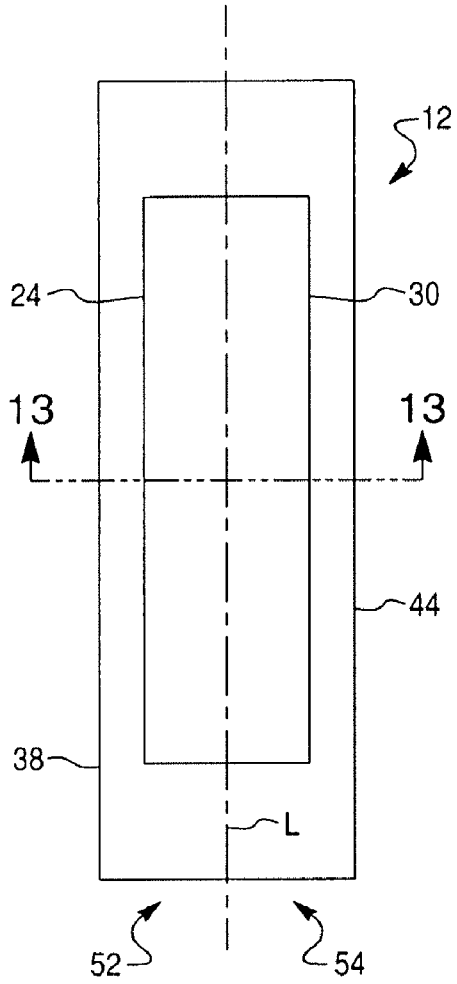
FIG. 12 is a plan view of a panel according to the present invention showing an imaginary longitudinal centerline in dashed line.
Figure 13:
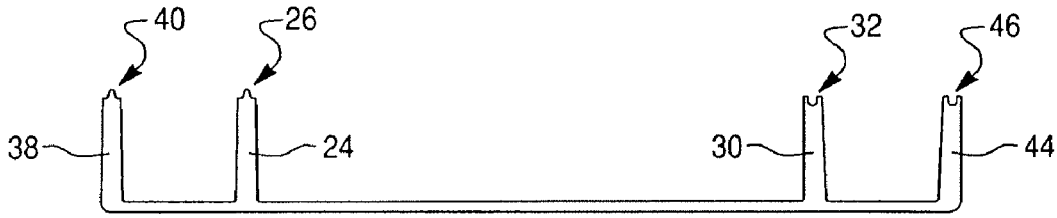
FIG. 13 is a sectional view of the panel shown in FIG. 12 taken along line 13-13 and viewed in the direction of the arrows.

As shown in FIGS. 12 and 13, panel 12 may include first and second halves 52, 54 relative to an imaginary longitudinal centerline L. First half 52 includes first portion 24 (shown by bold line in FIG. 12) having ridge 26 and first portion 38 (shown in bold line in FIG. 12) having ridge 40. Second half 54 includes second portion 30 having channel 32 and second portion 44 having channel 46. In this way, when inner and outer edges 22, 34 of two panels 12 are aligned with and abutting each other, ridges 26, 40 of one of panels 12 are aligned with and received in channels 32, 46 of the other of panels 12.

Therefore, the same panel 12 (or 14) may be used for both panel halves (12, 14) of sidelite assembly 10. It will be understood to one skilled in the art that other arrangements of ridges 26, 40 and channels 32, 46 may be provided on panel 12 (or 14) such that one panel 12 may be inverted or rotated and align with another panel 12 for securing ridges 26, 40 within channels 32, 46.

The specific dimensions of ridges 26, 40 and channels 32, 46 may vary depending on the material used to form panels 12, 14, the core material used, the dimensions of sidelite assembly 10, and other like processing considerations. Preferably, ridge 26 has a slightly smaller height and width compared to channel 32. Ridge 26 may also include a rounded apex 64. The width of ridge 26 may narrow as it extends outwardly to apex 64. Ridge 40 may have similar dimensions.

Channel 32 preferably has a complementary configuration for receiving ridge 26. For example, channel 32 may include a U-shaped configuration in cross-section for receiving apex 64 of ridge 26. However, channel 32 preferably has slightly larger dimensions compared to ridge 26 to provide for adequate tolerance between ridge 26 and channel 32. Tolerance between ridge 26 and channel 32 should provide sufficient clearance such that interference between ridge 26 and channel 32 is minimized. In addition, the slightly larger dimension of channel 32 allows space for adhesive, which may be used to secure panel 12 to panel 14. Channel 46 may have similar dimensions.

Although adequate clearance between ridge 26 and channel 32 should be provided to avoid tolerance problems, ridge 26 should be fit within channel 32 sufficiently snug so that ridge 26 is not forced or pulled out from channel 32 either during or after manufacture, including during foaming. When foam is injected into cavity 50, pressure is exerted against inner and outer edges 22, 34. Ridge 26 is sufficiently secured within channel 32, and ridge 40 within channel 46, such ridges 26, 40 and channels 32, 46 act as darns during foaming when panels 12, 14 are mated. Ridges 26, 40 push against the sides of channels 32, 46 during foaming, thereby creating a foam tight seal between panel 12 and panel 14.

Figure 14:
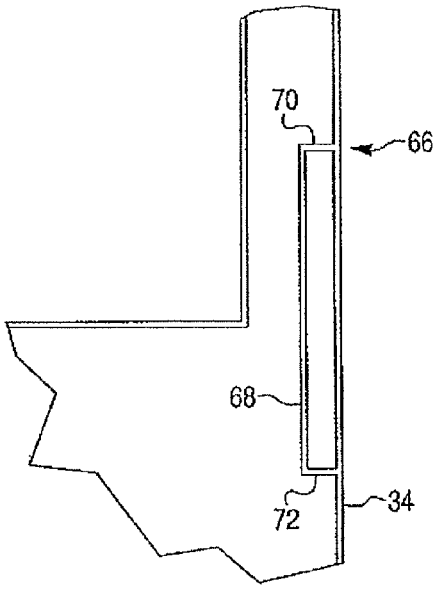
FIG. 14 is an exploded view of circled portion D shown in FIG. 3.

Preferably, each panel 12, 14 includes at least one U-shaped pocket 66 disposed intermediate inner and outer edges 22, 34, as best shown in FIGS. 2 and 14. Pocket 66 includes an inner wall 68 spaced from outer edge 34, preferably extending parallel to outer edge 34, and first and second side walls 70, 72 extending from opposite ends of inner wall 68 to outer edge 34. Pocket 66 forms a receiving area in which a portion of a block 74 is received. Each panel 12, 14 preferably includes multiple pockets 66. For example, three pockets 66 may be provided along each longitudinal side of panel 12 (or 14), as shown in FIG. 2.

When inner and outer edges 22, 34 of panels 12, 14 are aligned, pockets 66 are likewise aligned, as shown in FIG. 10. Each block 74 includes a first portion 76 that is received in pocket 66 of one of panels 12 (or 14), and a second portion 78 that is received in a corresponding pocket 66 of the other panel 12 (or 14).

Figure 4:
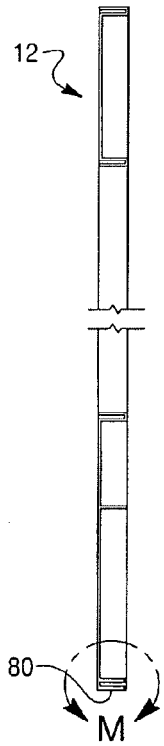
FIG. 4 is a fragmentary sectional view of the panel of FIG. 3 taken along lines G-G and viewed in the direction of the arrows.
Figure 5:
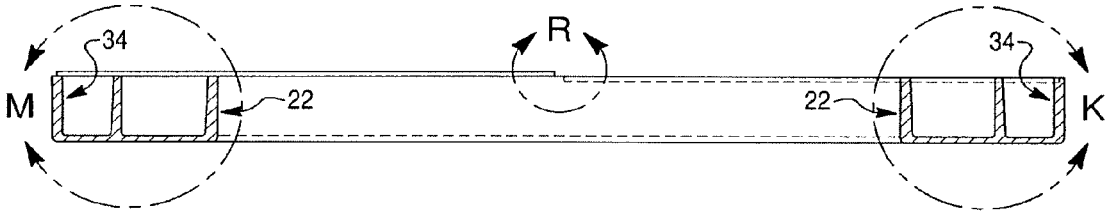
FIG. 5 is a sectional view of the panel of FIG. 3 taken along lines A-A and viewed in the direction of the arrows.
Figure 5A:
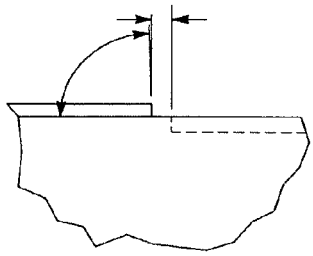
FIG. 5A is an exploded view of circled portion R shown in FIG. 5.
Figure 6:
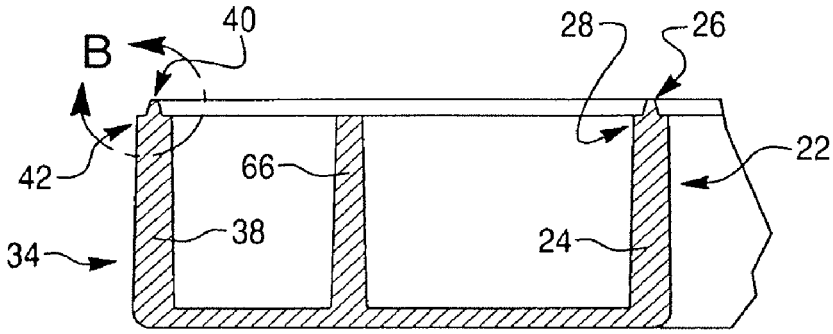
FIG. 6 is an exploded view of circled portion H shown in FIG. 5.
Figure 7:
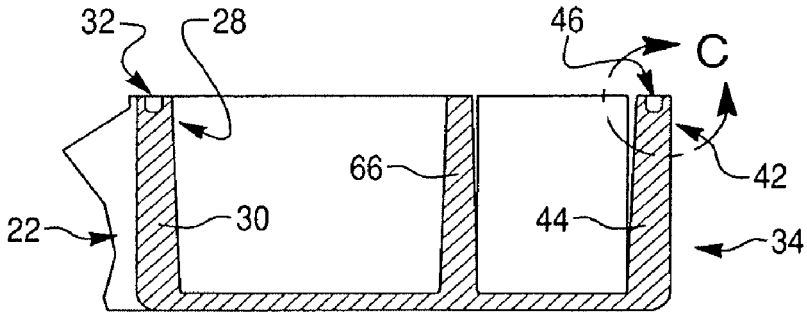
FIG. 7 is an exploded view of circled portion K shown in FIG. 5.
Figure 8:
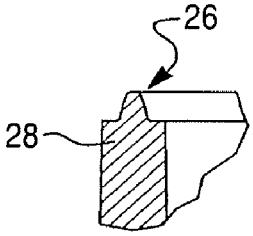
FIG. 8 is an exploded view of circled portion B shown in FIG. 6.
Figure 9:
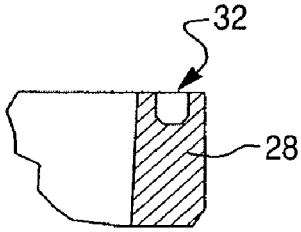
FIG. 9 is an exploded view of circled portion C shown in FIG. 7.
Figure 14A:
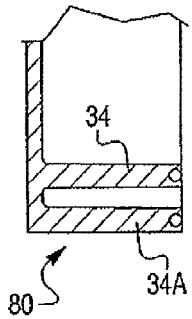
FIG. 14A is an exploded view of circled portion M shown in FIG. 4.

As best shown in FIGS. 4 and 14A, a lower end 80 of panel 12 (or 14) may include outer edge 34, as well as an extension edge 34A parallel to and outwardly spaced from outer edge 34 relative to opening 20. Extension edge 34 preferably has an identical configuration to outer edge 34. Depending on the dimensions of the framing provided for receiving sidelite assembly 10, extension edge 34 may be maintained on sidelite assembly 10 for applications requiring a longer sidelite assembly 10. Alternatively, extension edge 34 may be removed, resulting in a shorter sidelite assembly 10. Trimming extension edge 34 does not affect the cavity 50 given outer edge 34 is maintained.

Different door and sidelite units may require sidelite assemblies having differing lengths. For example, the assignee of the present application manufactures some door and sidelite assemblies having openings for receiving a sidelite assembly having a length of about 791;4 inch, and another assembly having a length of about 79 inch. Extension edge 34A ensures that sidelite assembly 10 may be used for door and sidelite assemblies requiring differently sized sidelite assemblies. Extension edge 34A may be spaced from outer edge 34 by a predetermined distance. If sidelite assembly 10 is to be installed in a door assembly requiring a sidelite assembly having a lengthy of 79½ inch, sidelite assembly 10 is simply installed in the door assembly opening. However, extension edge 34A may be removed if sidelite assembly 10 is to be installed in a door assembly opening requiring a sidelite assembly having a length of 79 inches.

It will be understood to one skilled in the art that the spacing of extension edge 34A from outer edge 34 may be varied depending on the particular door assembly dimensions. In addition, two or more extension edges 34A may be provided to increase versatility. In addition, an extension edge could be provided along a longitudinal edge of panel 12 (or 14) in order to provide adjustability of width of sidelite assembly 10.

Figure 27:
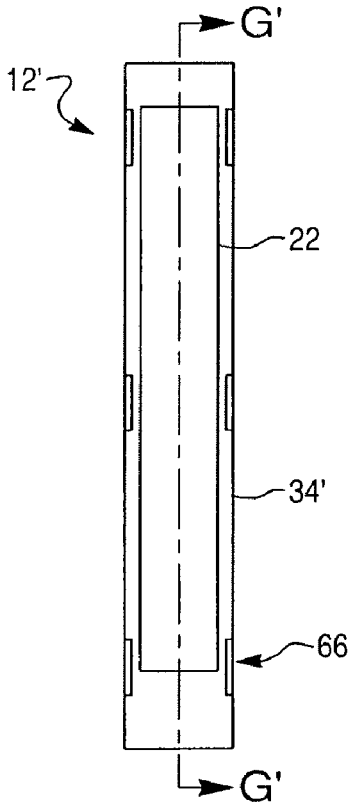
FIG. 27 is a plan view of another panel for a sidelite assembly according to the present invention.
Figure 28:
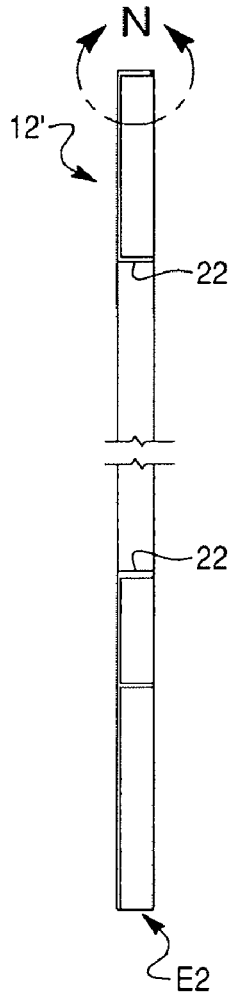
FIG. 28 is a fragmentary sectional view of the panel of FIG. 27 taken along lines G'-G' and viewed in the direction of the arrows.
Figure 29:
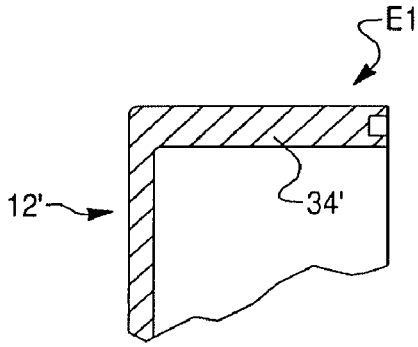
FIG. 29 is an exploded view of circled portion N shown in FIG. 28.
Figure 30:
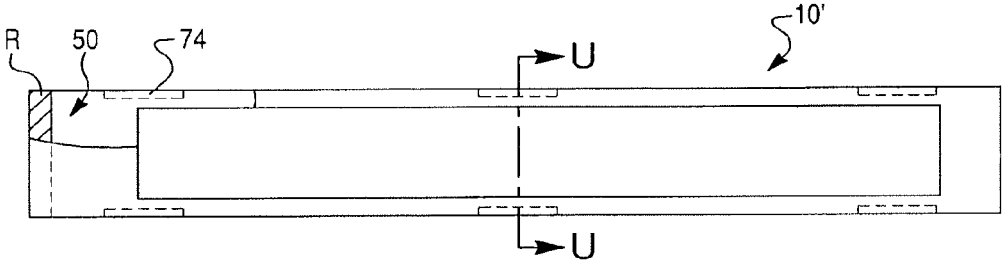
FIG. 30 is a plan view of a sidelight assembly showing a portion of an upper panel cutaway and internal portions in phantom.
Figure 31:
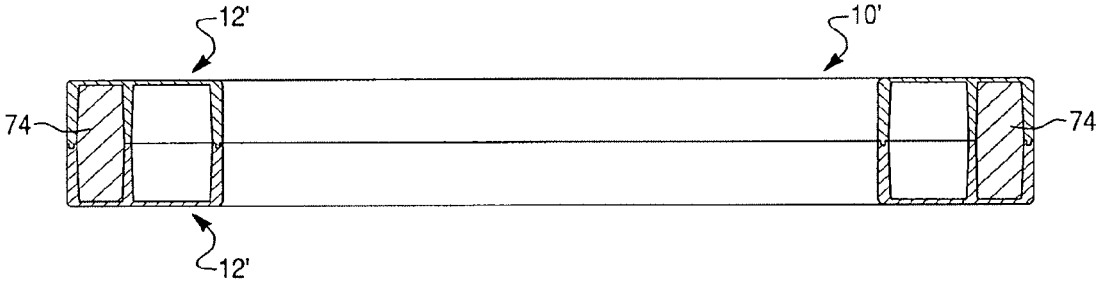
FIG. 31 is a sectional view of the sidelight assembly of FIG. 30 taken along lines U-U and viewed in the direction of the arrows.

Alternatively, a solid bottom rail R may be provided, which may be trimmed to length. As best shown in FIGS. 27-29, a molded panel 12' includes inner edge 22 and an outer edge 34'. Outer edge 34' extends along the longitudinal sides of panel 12' and along a top edge E1 of panel 12', as best shown in FIGS. 27 and 29. However, panel 12' does not include outer edge 34' along a lower edge E2 opposite top edge E1, as best shown in FIG. 28. Rather, a solid bottom rail R is provided, as best shown in FIG. 30. The lower edges E2 of opposed molded panels 12' are secured to rail R to form sidelight assembly 10', as best shown in FIG. 30. The lower edge E2 of molded panels 12' may be trimmed prior to assembly to achieve a desired length for the resulting sidelight assembly 10'. Alternatively, panels 12' may be secured together, with inner edges 22 and outer edges 34' aligned and secured together, and lower edges E2 of panels 12' secured to rail R, as best shown in FIGS. 30 and 31. In this way, the length of sidelight assembly 10' may be easily trimmed to a desired length but simply removing a portion of lower edges E2 and rail R.

Figure 15:
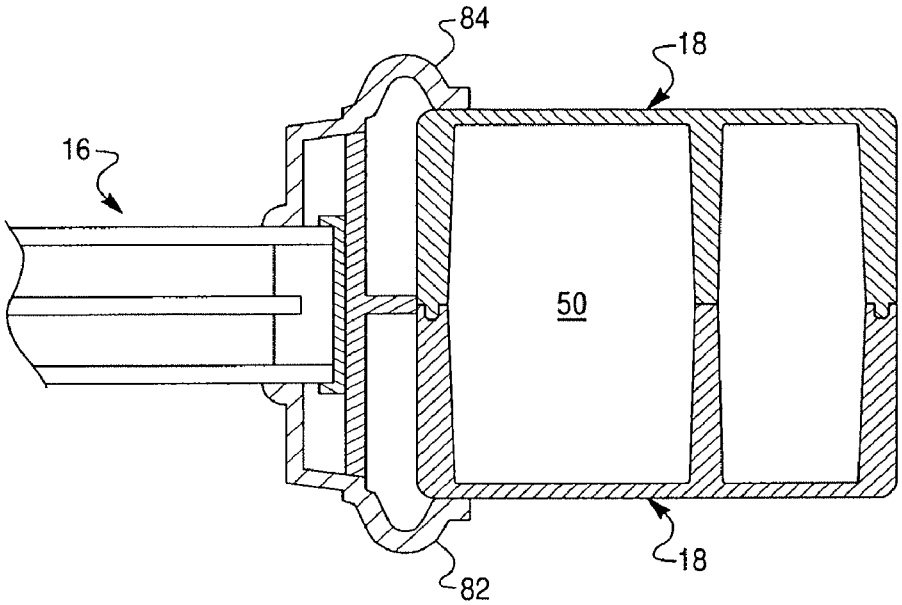
FIG. 15 is a fragmentary sectional view of a sidelite assembly of the present invention.
Figure 16:
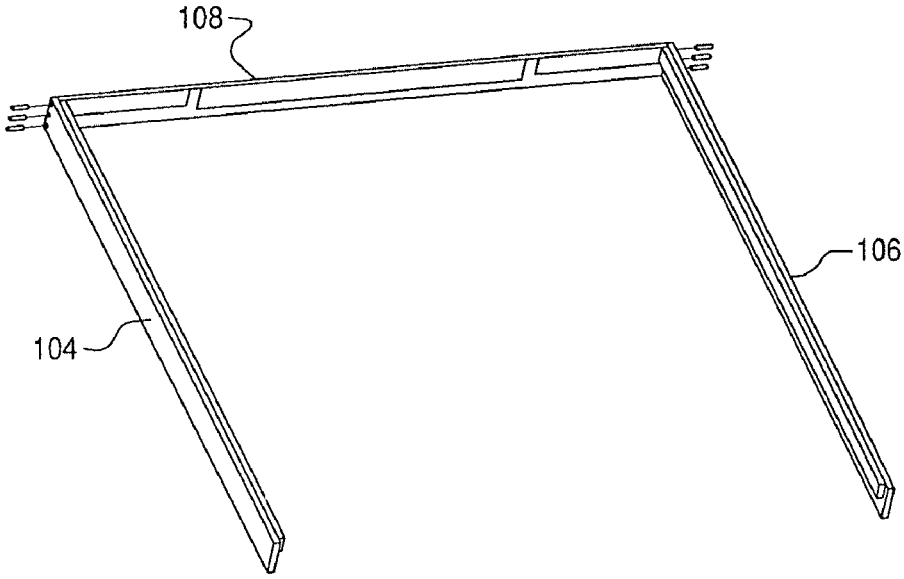
FIG. 16 is a perspective view of a header and sidelite jambs for a door and sidelite assembly according to the present invention.
Figure 17:
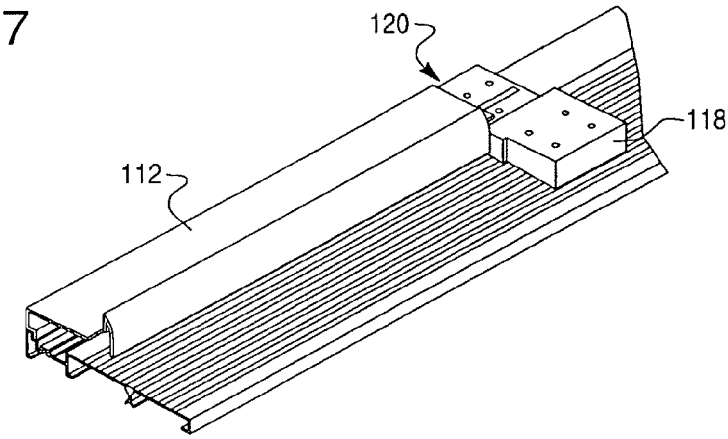
FIG. 17 is an exploded perspective view of a threshold, sidelite spacer and mullion for the door and sidelite assembly of the present invention.
Figure 18:
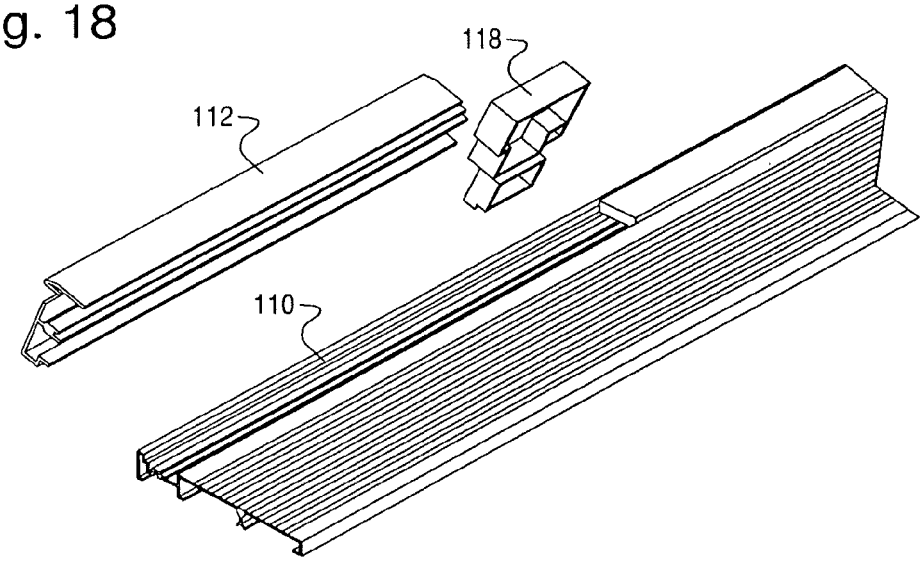
FIG. 18 is a perspective view of a threshold, sidelite spacer and mullion for the door and sidelite assembly of the present invention.
Figure 20:
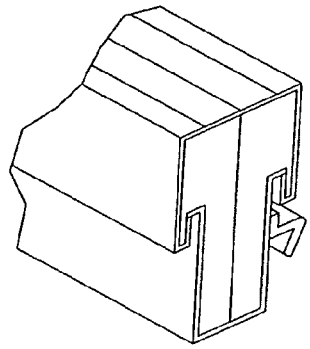
FIG. 20 is a fragmentary perspective view of a door jamb for the door and sidelite assembly of the present invention.
Figure 19:
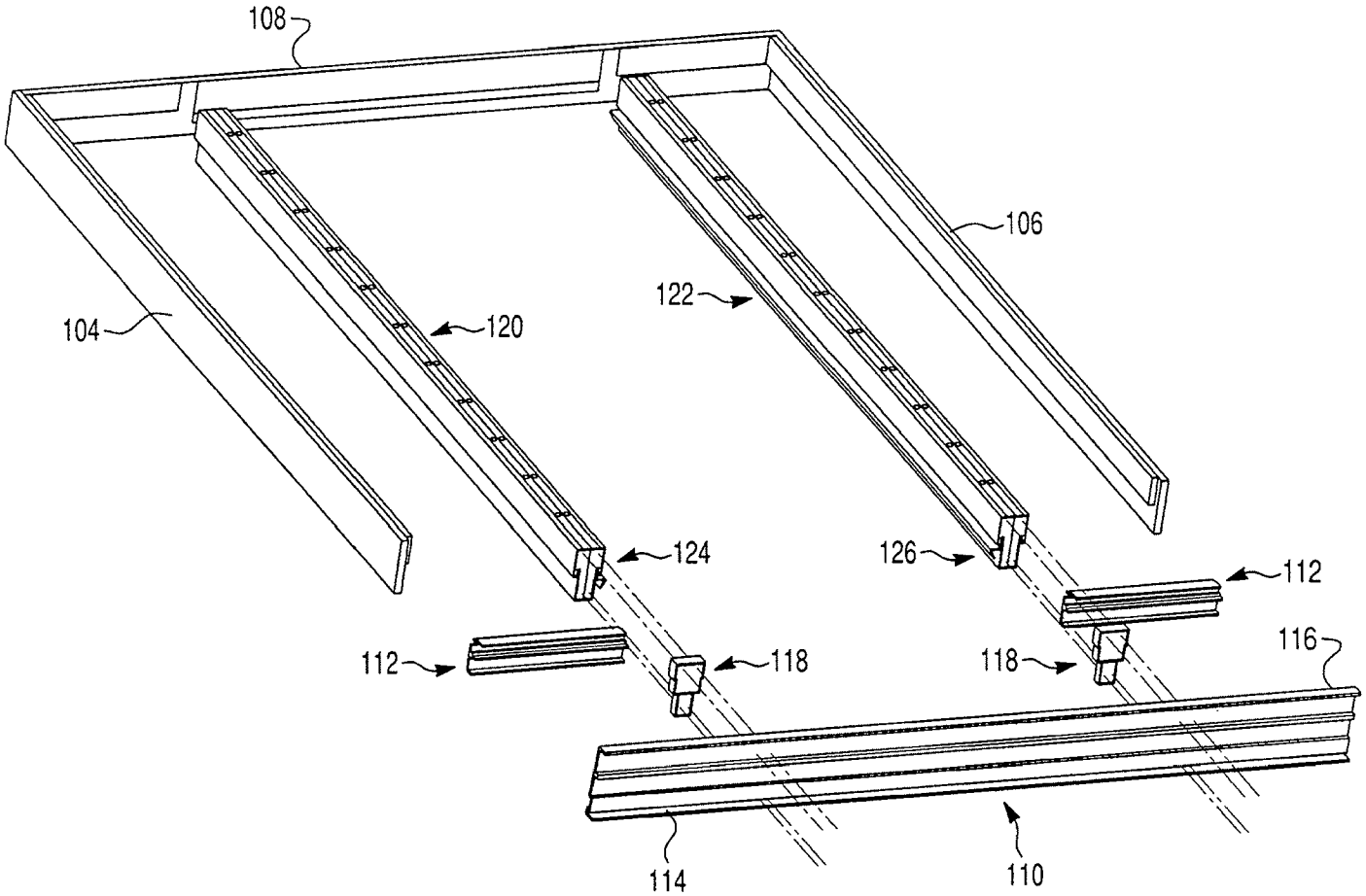
FIG. 19 is an assembly view of a frame for the door and sidelite assembly of the present invention.
Figure 21:
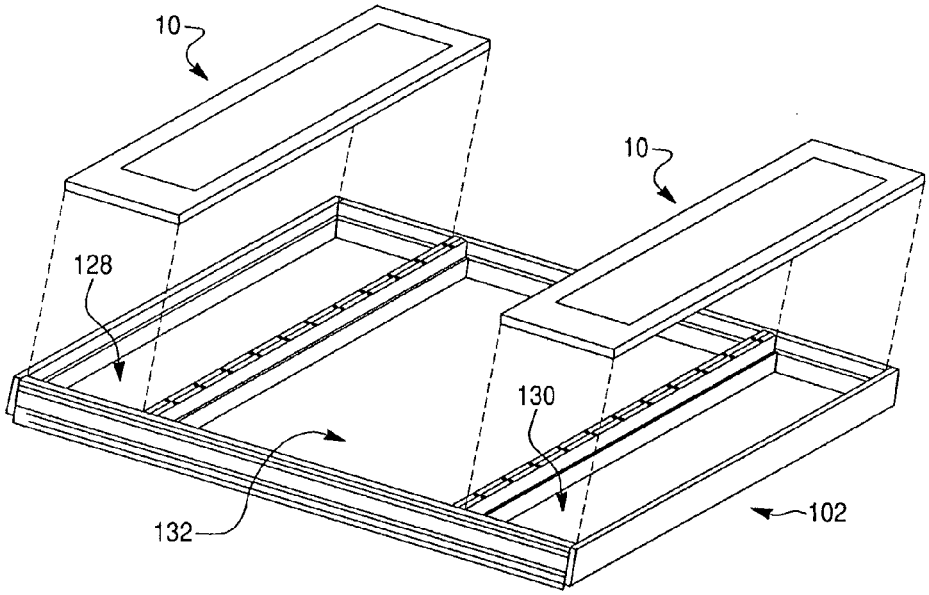
FIG. 21 is a perspective view of the frame and first and second sidelite assemblies for a door and sidelite assembly according to the present invention.
Figure 22:
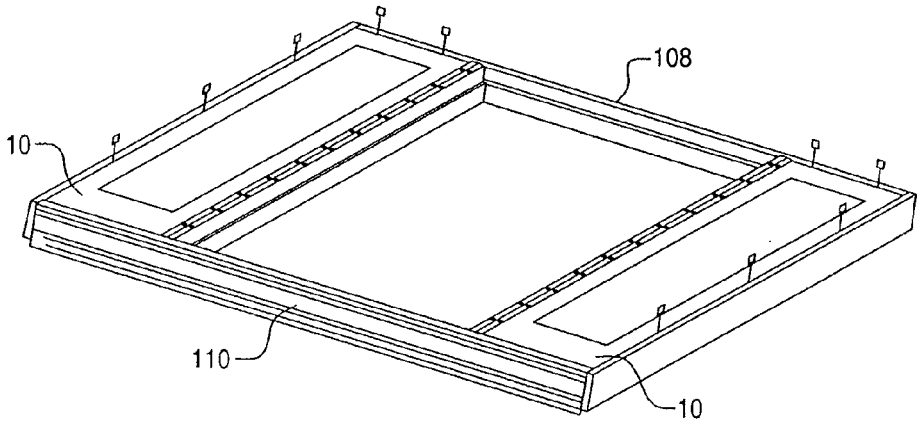
FIG. 22 is a perspective view of the first and second sidelite assemblies installed in the frame of the door and sidelite assembly according to the present invention.
Figure 23:
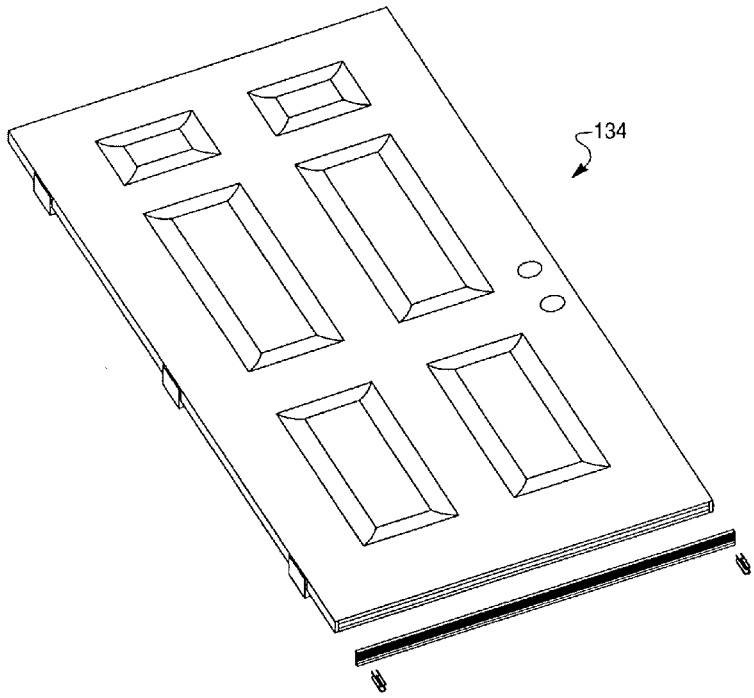
FIG. 23 is a perspective view of a door for the door and sidelite assembly according to the present invention.
Figure 24:
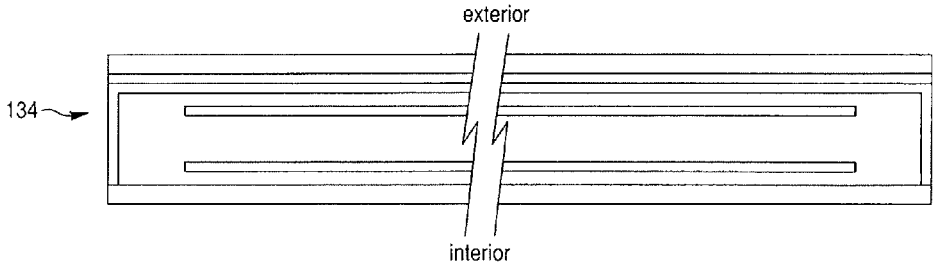
FIG. 24 is a fragmentary cross-sectional view of the door for the door and sidelite assembly according to the present invention.
Figure 25:
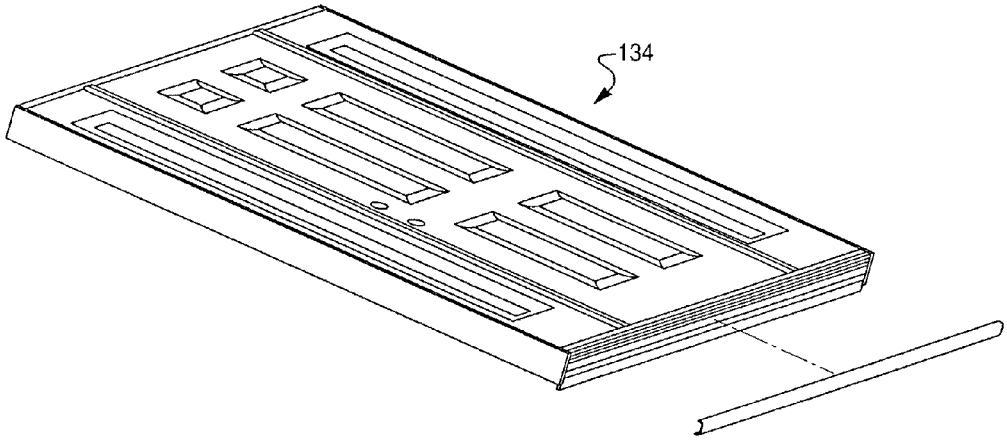
FIG. 25 is a perspective view of the door and sidelite assembly according to the present invention.

As best shown in FIG. 15, glazing panel 16 may be provided in a frame and sized to fit within opening 20. First and second molding halves 82, 84 are provided, which are clamp around the perimeter of glazing panel 16 and opening 20. Thus, glazing panel 16 is sandwiched between molding halves 82, 84. Molding halves 82, 84 also overlap major planar surfaces 18 adjacent cutouts 20 of panels 12, 14, thereby securing glazing panel 16 in place.

Alternatively, a saddle and glazing beads may be secured to panels 12, 14 surrounding opening 20, such as described in co-pending patent application Ser. No. 10/981744, Publication No. 2005/0193655, the disclosure of which is incorporated herein by reference.

Alternatively, panels 12, 14 may include contoured portions extending inwardly from the plane of major planar surface 18 and into opening 20. An edge of the contoured portion defines opening 20, and abuts either a window frame or window spacer as described more fully in co-pending application Ser. No. 10/851,659, Publication No. 2005/0028465, the disclosure of which is incorporated herein by reference.

Regardless of the specific configuration of panels 12, 14 and/or glazing panel 16, inner and outer edges 22, 34 either define or are spaced from opening 20 so that any foam injected into cavity 50 will not leak into opening 20.

The present invention is also directed to a door and sidelite assembly 100, and method of forming same. As best shown in FIGS. 16-26, assembly 100 includes an outer frame 102 having first and second sidelite jambs 104, 106 and a header 108. A threshold 110 is provided which extends along bottom ends of side jambs 104, 106 opposite header 108. Sidelite spacers 112 are secured to opposite ends 114, 116 of threshold 110. First and second mullion boots 118 are secured to threshold 110, each mullion boot 118 secured adjacent a corresponding end 120 of one of sidelite spacers 112.

Figure 26:
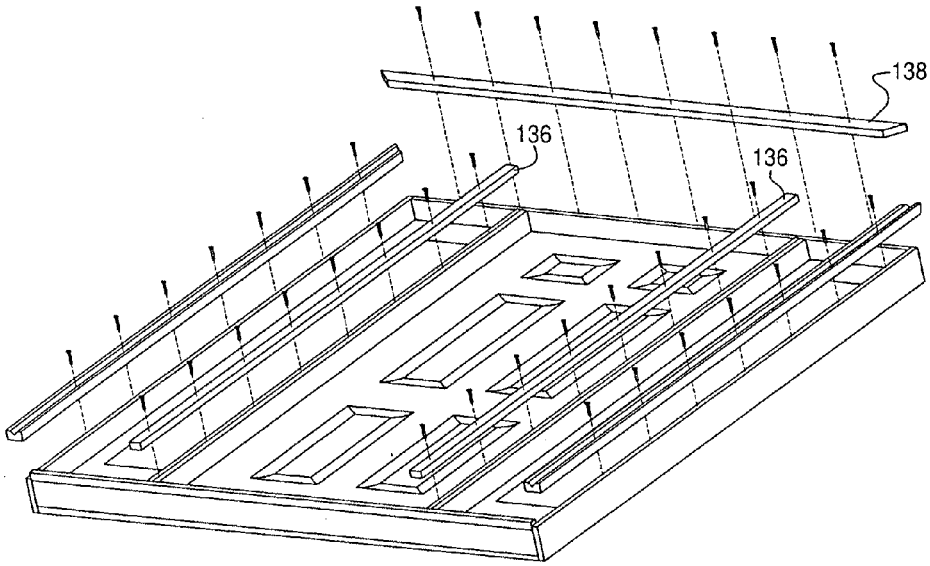
FIG. 26 is an assembly view of storm door spacers and brickmold for the door and sidelite assembly according to the present invention.

First ands second door jambs 120, 122 are provided, which extend from header 108 to threshold 110. The bottom ends of door jambs 124, 126 are received on and secured to mullion boots 118. The resulting frame 102 includes first and second sidelite openings 128, 130 for receiving first and second sidelite assemblies, such as sidelite assembly 10 described above, and a central opening 132. A door 134 is received in a central opening 132. Storm door spacers 136 and brickmold 138 may be secured to the exteriorly disposed face of door and sidelite assembly 100, as best shown in FIG. 26. Any joints and spaces in door and sidelite assembly 100 may then be caulked.

It should be understood that the disclosed embodiments are for purposes of explanation only, and the present invention is not so limited. Further, it would be apparent to one of ordinary skill in the art that various modifications and variations can be made in construction or configuration of the present invention without departing from the scope or spirit of the invention. Therefore, the present invention is intended to include all such modifications and variations, provided they come within the scope of the following claims and their equivalents.

What is claimed is:

1. A sidelite assembly, comprising:

first and second panels having first and second major planar portions, respectively, that collectively define an opening for receiving a glazing panel, the first panel comprising a first inner edge portion and a first outer edge portion extending from the first major planar portion, the first inner edge portion surrounding the opening and including an inner edge ridge extending from a distal end of the first inner edge portion, the first outer edge portion positioned adjacent to a periphery of the first major planar portion and including an outer edge ridge extending from a distal end of the first outer edge portion, the first panel further comprising a first extension edge portion including a first parallel leg extending parallel to the first major planar portion and a first perpendicular leg extending perpendicular to the first parallel leg, the first extension edge portion including an extension ridge extending from a distal end of the first extension edge portion, the second panel comprising a second inner edge portion and a second outer edge portion extending from the second major planar portion, the second inner edge portion surrounding the opening and having an inner edge channel extending into a distal end of the second inner edge portion, the second outer edge portion positioned adjacent to the periphery of the second major planar portion and having an outer edge channel extending into a distal end of the second outer edge portion, the second panel further comprising a second extension edge portion including a second parallel leg extending parallel to the second major planar portion and a second perpendicular leg extending perpendicular to the second parallel leg, the second extension edge portion including an extension channel extending into a distal end of the second extension edge portion, wherein the inner edge ridge and the outer edge ridge are received in the inner edge channel and the outer edge channel, respectively, to align the first and second panels with one another and form a cavity between the first and second major planar portions, wherein the extension ridge is received in the extension channel, and wherein the first and second extension edge portions are removable from the panels without disturbing the cavity.

2. The sidelite assembly of claim 1, wherein the first and second major planar portions have identical configurations, except for the ridges and the extensions.

3. The sidelite assembly of claim 1, wherein the first panel further comprises a first inner wall intermediate the first inner edge portion and the first outer edge portion, wherein the second panel further comprises a second inner wall intermediate the second inner edge portion and the second outer edge portion, and wherein the first and second inner walls are aligned with one another to establish a pocket between the aligned inner walls and the first and second outer edge portions.

4. The sidelite assembly of claim 1, wherein the first inner edge portion and the first outer edge portion extend perpendicularly from the first major planar portion, and wherein the second inner edge portion and the second outer edge portion extend perpendicularly from the second major planar portion.

5. The sidelite assembly of claim 1, wherein the first and second panels are first and second door panels, respectively.

6. The sidelite assembly of claim 1, further comprising a core disposed in the cavity.

7. The sidelite assembly of claim 6, wherein the core comprises a material selected from the group consisting of polyurethane foam, expanded polystyrene, wood composite, and cardboard.

8. The sidelite assembly of claim 1, wherein the peripheries of the first and second major planar portions are rectangular.

9. The sidelite assembly of claim 1, wherein the first and second panels are formed of a fiberglass-reinforced composite material.

10. The sidelite assembly of claim 1, further comprising the glazing panel received in the opening.

11. A door and sidelite assembly, comprising:

a header having opposite first and second ends;

a sidelite jam secured to the first end of the header;

a first door jamb secured to the header;

a second door jamb secured to the header and positioned between the sidelite jamb and the first door jamb;

a door situated between the first and second door jamb and secured to at least one of the door jambs; and the sidelite assembly of claim 1 situated between the second door jamb and the sidelite jamb.

12. A sidelite assembly, comprising:

first and second panels having first and second major planar portions, respectively, that collectively define an opening for receiving a glazing panel, the first panel comprising a first inner edge portion and a first outer edge portion extending from the first major planar portion, the first inner edge portion surrounding the opening, the first outer edge portion positioned adjacent to a periphery of the first major planar portion, the first inner edge portion including a first inner edge ridge on a first half of the first panel relative to an imaginary longitudinal centerline and having a first inner edge channel on a second half of the first panel relative to the imaginary longitudinal centerline; the first outer edge portion including a first outer edge ridge on the first half of the first panel relative to the imaginary longitudinal centerline and having a first outer edge channel on the second half of the first panel relative to the imaginary longitudinal centerline, the second panel comprising a second inner edge portion and a second outer edge portion extending from the second major planar portion, the second inner edge portion surrounding the opening, the second outer edge portion positioned adjacent to a periphery of the second major planar portion, the second inner edge portion including a second inner edge ridge on a first half of the second panel relative to the imaginary longitudinal centerline and having a second inner edge channel on a second half of the second panel relative to the imaginary longitudinal centerline; the second outer edge portion including a second outer edge ridge on the first half of the second panel relative to the imaginary longitudinal centerline and having a second outer edge channel on the second half of the second panel relative to the imaginary longitudinal centerline, the first and second panels further collectively forming a removable extension edge configured to be removed without disturbing a cavity established between the first and second major planar portions and the inner and outer edges of the first and second panels, wherein the first inner edge ridge and the first outer edge ridge are received in the second inner edge channel and the second outer edge channel, respectively, and the second inner edge ridge and the second outer edge ridge are received in the first inner edge channel and the first outer edge channel, respectively.

13. The sidelite assembly of claim 12, wherein the first and second major planar portions have identical configurations.

14. The sidelite assembly of claim 12, wherein the first panel further comprises a first inner wall intermediate the first inner edge portion and the first outer edge portion, wherein the second panel further comprises a second inner wall intermediate the second inner edge portion and the second outer edge portion, and wherein the first and second inner walls are aligned with one another to establish a pocket between the aligned inner walls and the first and second outer edge portions.

15. The sidelite assembly of claim 12, wherein the first and second panels are first and second door panels, respectively.

16. The sidelite assembly of claim 12, further comprising a core disposed in the cavity.

17. The sidelite assembly of claim 12, wherein the peripheries of the first and second major planar portions are rectangular.

18. The sidelite assembly of claim 12, wherein the first and second panels are formed of a fiberglass-reinforced composite material.

19. The sidelite assembly of claim 12, further comprising the glazing panel received in the opening.

20. A door and sidelite assembly, comprising:

a header having opposite first and second ends;

a sidelite jam secured to the first end of the header;

a first door jamb secured to the header;

a second door jamb secured to the header and positioned between the sidelite jamb and the first door jamb;

a door situated between the first and second door jamb and secured to at least one of the door jambs; and the sidelite assembly of claim 12 situated between the second door jamb and the sidelite jamb.

* * * * *